United States Patent [19]

Paylinsky

[11] Patent Number: 4,860,935

[45] Date of Patent: Aug. 29, 1989

[54] APPARATUS AND METHOD FOR CONTAINING SNOW SKIS AND SKI POLES

[76] Inventor: Joseph F. Paylinsky, 5650 Los Angeles Ave., Simi Valley, Calif. 93063

[21] Appl. No.: 168,918

[22] Filed: Mar. 16, 1988

[51] Int. Cl.[4] ..... A45F 3/02

[52] U.S. Cl. ..... 224/202; 224/257; 224/901; 224/917; 206/315.1; 294/147

[58] Field of Search ..... 224/202, 205, 218, 250, 224/255, 257, 258, 319, 901, 913, 916, 917; 206/315.1; 220/22.1, 335, 4 R; 229/93; 190/20, 115; 150/52 R; 294/147; D3/30.1, 36, 38, 76, 77, 104

[56] References Cited

U.S. PATENT DOCUMENTS

| | | | |
|---|---|---|---|
| D. 230,378 | 2/1974 | Eisenberg | D87/1 R |
| D. 257,913 | 1/1981 | O'Dair | D3/36 |
| 3,086,688 | 4/1963 | Vikre | 224/45 |
| 3,767,036 | 10/1973 | McLeod | 206/16 |
| 3,797,715 | 3/1974 | Scialdone | 224/901 |
| 3,837,548 | 9/1974 | Nerger | 224/45 |
| 3,960,302 | 6/1974 | Mazzoni et al. | 224/901 |
| 4,161,268 | 7/1979 | Heil | 224/45 |
| 4,238,063 | 12/1980 | O'Dair | 206/315.1 |
| 4,261,493 | 4/1981 | Newman | 224/257 |
| 4,380,290 | 4/1983 | Luebke | 206/315 |
| 4,402,355 | 9/1983 | Wymore et al. | 206/315.1 |
| 4,588,115 | 5/1986 | Uyeda | 224/218 |
| 4,643,302 | 2/1987 | Baumgardner | 206/315 |
| 4,644,986 | 2/1987 | Fusaro | 206/315.1 |
| 4,673,118 | 6/1987 | Kronz | 224/917 |
| 4,674,787 | 6/1987 | DeVera | 224/917 |

FOREIGN PATENT DOCUMENTS

| | | | |
|---|---|---|---|
| 1116141 | 1/1982 | Canada | 206/315.1 |

*Primary Examiner*—Harvey C. Hornsby
*Assistant Examiner*—Joseph S. Machuga
*Attorney, Agent, or Firm*—Blakely, Sokoloff, Taylor & Zafman

[57] ABSTRACT

An apparatus and method for containing snow skis and ski poles optimized for carrying selected quantities of pairs of skis and ski poles. The apparatus is characterized by a single, elongated tube with a hingedly attached lockable cap. Pairs of skis and ski poles are strapped together as a compact unit for convenient insertion in the small cross-sectioned tube. The tube cross-section incorporates large radius corners for increased crush-resistance.

8 Claims, 2 Drawing Sheets

APPARATUS AND METHOD FOR CONTAINING SNOW SKIS AND SKI POLES

BACKGROUND OF THE INVENTION

1. Field of the Invention

The present invention relates generally to containers for storing and carrying snow skis and ski poles and more particularly to a ski and ski pole containment apparatus and method which provides ease in containment while minimizing the cross-section of the container.

2. Description of the Prior Art

The prior art indicates that several attempts have been made to provide for the storing and carrying of skis, ski poles and/or ski boots.

For example, U.S. Pat. No. 4,161,268, issued to C. W. Heil discloses a complicated structure comprising three telescoping body members which must be adjusted and locked into position to fit a particular pair of skis. The exterior surface has numerous depressions and ribs.

U.S. Pat. No. 3,767,036, issued to W. N. McLeod discloses a two-part hinged container, much like a typical suitcase, having rigid masses mounted therein to receive ski equipment. This design bends the skis to increase the rigidity of the case. It contains a set of ski boots. A rigid metallic lip is affixed to the perimeter of each case half. Furthermore, exterior briefcase-type locks are affixed.

U.S. Pat. No. 3,086,688, issued to M. A. Vikre discloses a ski carrier particularly adaptable for use with water skis. The Vikre device uses a complex support arm mechanism and does not include an exterior shell for protection.

U.S. Pat. No. 4,643,302, issued to E. W. Baumgardner discloses a multiple sports equipment container comprising an elongated tube substantially elliptical in shape but having truncations at opposite extremities of the major elliptical axis. The Baumgardner device uses end caps having deep means of closure and access to a cavity of adjustable length within the container. This design is of extruded plastic and is not optimized for carrying a given quantity of skis and ski poles. Many articles, such as golf clubs and boat paddles may be carried.

U.S. Pat. No. 3,837,548, issued to D. Nerger, discloses a substantially rigid ski carrying case having oppositely disposed case portions comprising components or segments also provided with one or more removable sections which may. be attached to, and between, the case portions for extending or reducing the length of the case. All sections are hinged. As a result, the design is structurally significantly weaker than an integral tube and has numerous exterior fittings.

U.S. Pat. No. 4,380,290, issued to R. A. Luebke, discloses a container for articles, particularly elongated articles such as snow skis. Slidably disposed within the container is an adjustable partition to provide various sizes of storage compartments, the size depending upon the length of the article being stored therein. The selective positioning of the partition provides a secondary storage compartment.

OBJECTS OF THE INVENTION

A principal object of the present invention is to provide a ski container with a minimal cross-section and minimal weight.

Another object is to provide a high level of protection against ski and binding damage.

Another object is to provide a method for easily packing the skis and ski poles into a ski container.

Still another object is to provide a weather-resistant ski container.

Yet another object is to provide a ski container which is low in cost.

Other objects, advantages and novel features of the present invention will become apparent from the following detailed description of the invention when considered in conjunction with the accompanying drawing.

The aforementioned objects are achieved by the present apparatus and method for containing snow skis and ski poles. In its broadest aspects, the present invention comprises a rigid, integral elongated tube having two opposing, parallel flat surfaces with lengths, L, and widths equal to $W_L$; two opposing parallel, flat surfaces with lengths, L, and widths equal to $W_S$; and, four curved surfaces each curved surface having a radius of curvature, R, for joining the flat surfaces. The elongated tube therefore has a substantially rectangular cross-section but with curved surfaces at the corners of the cross-section. The geometrical dimensions of the cross-section of the elongated tube is defined by the relationships:

$$\left(\frac{[1 + .712(n - 1)]2R}{[5(n - 1) + W_L] + 2R}\right) = K_1, \tag{1}$$

where n=the number of strapped pairs of skis to be inserted into the ski container, $$K_1 = 0.457, \text{ and } R = 1.6,$$

$$\left[\frac{2R}{W_S + 2R}\right] = K_2, \text{ where } K_2 = 0.610. \tag{2}$$

One end of the elongated tube is open and the other end is closed. An end cap is hingedly attached to the open end and may be locked in place to close the tube. The aforementioned geometry of the elongated tube provides a minimal cross-section for containing the unique geometries of the skis and poles. In order to fit properly within this geometry, the skis and poles must be strapped together in a specific manner prior to their insertion within the container. The skis are oriented in the tip-to-tail fashion with the bindings facing each other so that the tip of one ski is adjacent to the tail of its paired ski. Ski poles are located adjacent each other on one side of the skis between the edges of the skis.

The elongated tube is preferably formed of blow-molded plastic. Thus, by novel combination of the elongated tube and packed geometry of the skis and ski poles, an apparatus and method for containing skis is provided which is of low cost, is of minimal weight, minimal cross-section while not compromising the high level of protection needed to protect against ski and binding damage. Furthermore, this geometry results in a clean, pleasing, stream-lined appearance which compliments the sportsman-like nature of most skiers and current automobile design.

BRIEF DESCRIPTION OF THE DRAWINGS

The same elements or parts throughout the figures are designated by the same reference characters, while equivalent elements bear a prime designation.

DETAILED DESCRIPTION OF THE INVENTION

Figure 1:
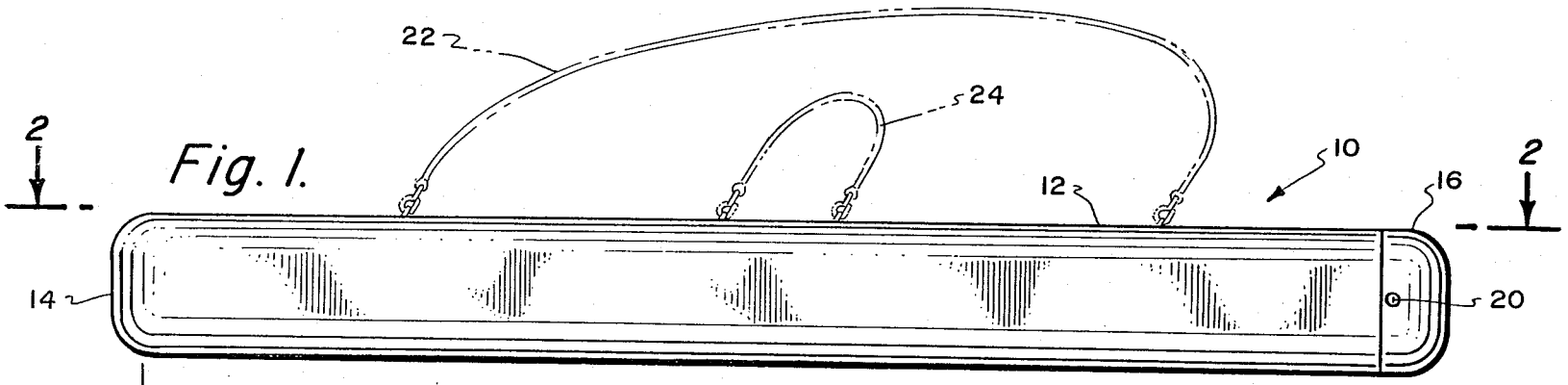
FIG. 1 is a side perspective view of the ski container of the present invention.

Referring to the drawings and the characters of reference marked thereon, FIG. 1 illustrates a side perspective view of the ski container of the present invention, generally designated 10. The apparatus 10 comprises an elongated tube 12 of sufficient length to contain skis. Elongated tube 12 has one closed end 14 and an open opposite end with an end cap 16 attached thereon. The end cap 16 is secured to the elongated tube 12 by a hinge (designated 18 in FIG. 3) and locking means 20. Locking means 20 may comprise a cam-type lock or other conventional lock, preferably of the key or combination type. Carrying straps 22,24 are provided to conveniently carry the ski container 10 by the hand and/or shoulder.

Figure 2:
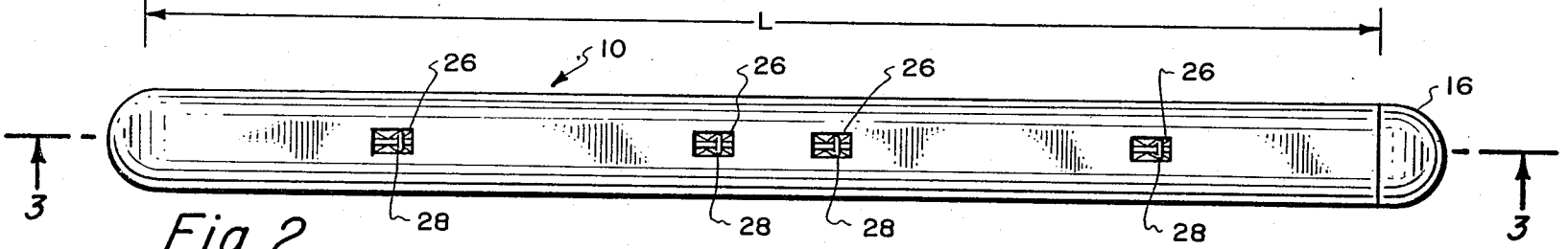
FIG. 2 is a top perspective view of the ski container of the present invention, taken along line 2—2 of FIG. 1.

As shown in FIG. 2, four indented locations 26 on the top surface of apparatus 10 provide access for attachment of the straps 22,24. Fasteners 28 may comprise, for example, standard heavy-duty plastic lips and D-rings. The straps 22,24 may be removable for auto and airline travel and stowed inside the tube.

Figure 3:
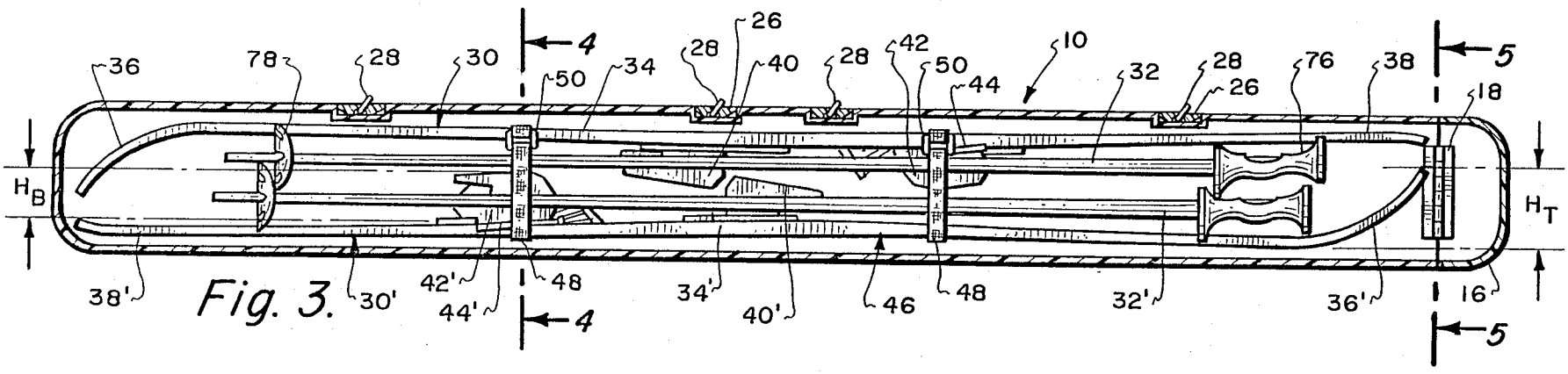
FIG. 3 is a side, partial cross-section of the ski container of the present invention, with the skis and poles contained therein, taken along line 3—3 of FIG. 2.

Referring now to FIG. 3, a side partial cross-section of the apparatus 10 is shown with a pair of snow skis 30,30' and ski poles 32,32' located therein. As can be readily seen by this Figure, each ski 30 has a substantially flat portion 34 and tip 36 formed on the forward portion of the ski 30 and curved from the flat portion 34. The flat portion 34 terminates in a tail end 38. Each ski 30 further has a toe binding 40 for supporting the toe of the ski boot and a heel binding 42 for supporting the heel of the ski boot. The bindings 40,42 are each securely attached to the flat portion 34.

Each heel binding 42 includes a ski brake 44 attached thereto. In its normal position each ski brake 44 normally extends at a significant angle (i.e. approximately 45 ° from the plane of the flat portion 34 of the ski 30. However, the ski brake 44 may become depressable so as to change its angular orientation, and become substantially parallel to the plane of the flat portion 34 of ski 30.

Prior to being inserted into the elongated tube 12 a pair of skis 30,30' and a pair of ski poles 32,32' are strapped together as a single unit, generally designated 46. The formation of such a strapped unit 46 allows for convenient insertion and removal of the skis and poles from the ski container 12.

Figure 4:
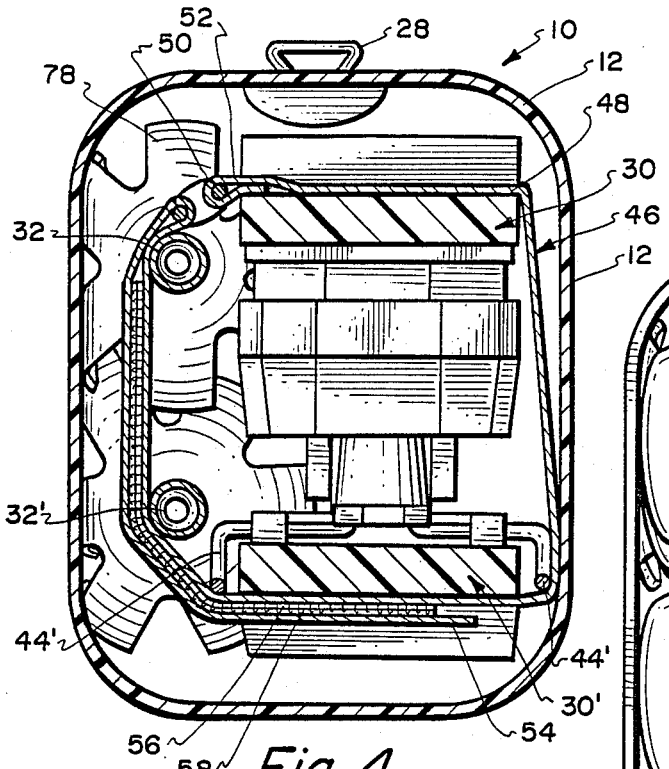
FIG. 4 is an end view of the ski container, taken along line 4—4 of FIG. 3.

Prior to being strapped, the skis 30,30' are oriented in a tip-to-tail fashion, that is, so that the tip 36 of one ski 30 is adjacent to the tail 38' of the other paired ski 30'. A strap 48 is utilized with a rigid loop 50 attached to one end 52, as shown in FIG. 4. The strap 48 is wound around the pair of skis in a first direction at the location of the ski brake 44. The other end 54 of the strap 48 is directed through the loop 50 and pulled in a second direction opposite from the first direction and with sufficient tension to depress the ski brake 44 and to maintain the skis in close proximity.

The ski poles 32 are placed on one side of the skis 30, as shown in FIG. 4. Furtheraore, the ski poles 32 are disposed between the dges of the skis 30,30'. Thus, as the strap 48 is wound in the second direction it wraps around the ski poles 32,32' as well as the skis 30,30'. End 54 is then fastened to a fastening location on the strap 48. This is preferably accomplished by providing end 54 with a mating half 56 of adhesive strip of synthetic material of the type that adheres when pressed together with a corresponding mating strip 58 (commonly sold under the trademark "VELCRO"). The strap 48 is preferably formed of a webbed cloth, however other suitable materials such as nylon may be utilized. Fastened together as a compact unit 46 the skis 30,30' and poles 32,32' may be inserted into the novel elongated container 12 which is specially formed to contain the unit 46.

Figure 5:
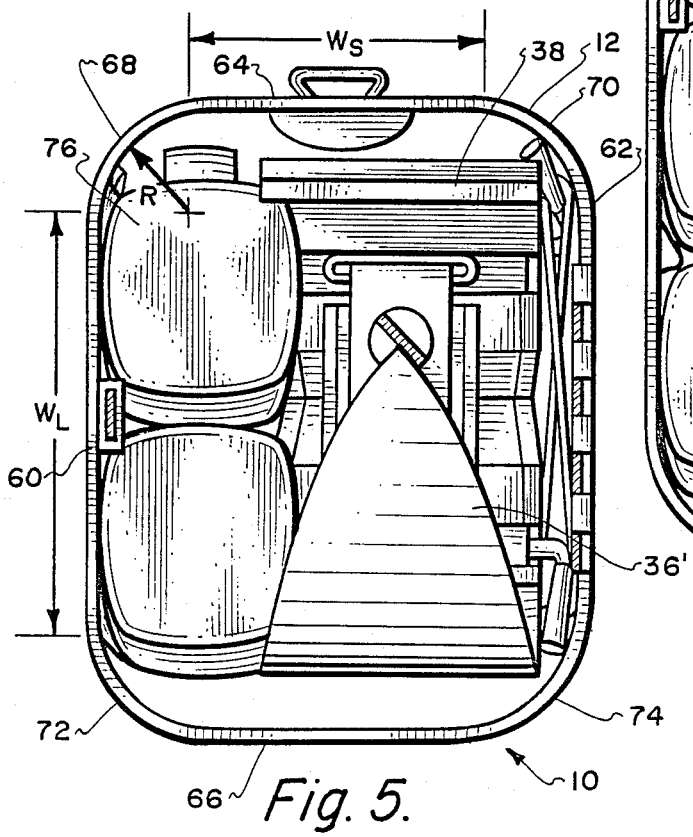
FIG. 5 is an end view of the ski container, taken along line 5—5 of FIG. 3.

Referring now to FIG. 5, the elongated tube 12 has two opposing parallel flat surfaces 60,62 having lengths, L, and widths, $W_L$. (The length, L, is designated in FIG. 1.) Two other opposing flat surfaces 64,66 are oriented perpendicular to surfaces 60,62 and have the same length, L as those two surfaces, but have shorter widths, $W_S$. Four curved surfaces 68,70,72,74, each having a radius of curvature, R, join the flat surfaces. Thus, the elongated tube 12 has a substantially rectangular cross-section but has curved surfaces 68,70,72,74 at the corners of the cross-section. The geometrical dimensions of the cross-section of the embodiment illustrated in FIGS. 1–5 is defined by the relationships $$\left[\frac{2R}{W_L + 2R}\right] = K_1, \text{ where } K_1 = 0.457, \text{ and } R = 1.6, \text{ and} \quad (1)$$

$$\left[\frac{2R}{W_S + 2R}\right] = K_2, \text{ where } K_2 = 0.610. \quad (2)$$

Applicant has found that design adherence to these equations provides minimal cross-section resulting in minimal weight, minimal exterior size, and excellent bending strength and crush resistance.

A minimal side-to-side envelope is obtained by interlocking the ski bindings such that the tip and tail of opposing skis are on the same plane perpendicular to the ski axis. This configuration minimizes the lateral dimension by limiting the lateral variables to one ski tip height, $H_T$, and one binding height, $H_B$ (see FIG. 3). Most common skis stored in this configuration have a total width of under seven inches. Vertical height is a function of ski brake width, ski width, binding height and ski pole handle 76 size. Stacking the ski poles on one side of the skis minimizes total ensemble height because the ski baskets 78 are flexible and are deflected by surface 60 and therefore allow the ski pole handles to be pivoted downward allowing a reduced total height.

The elongated tube is preferably formed of a blow-molded-type plastic, such as the product commonly sold under the trademark "GELOY". In its manufacture, a tube with two closed ends is first formed. After the blow-molding process is completed one of the closed ends is detached and reattached using a bonded hinge assembly and lock. The fittings for the straps may be bonded or riveted into blow-molded depressions. The mold for blowmolding may incorporate removable sections so as to provide variable-lengthed tubes.

Figure 6:
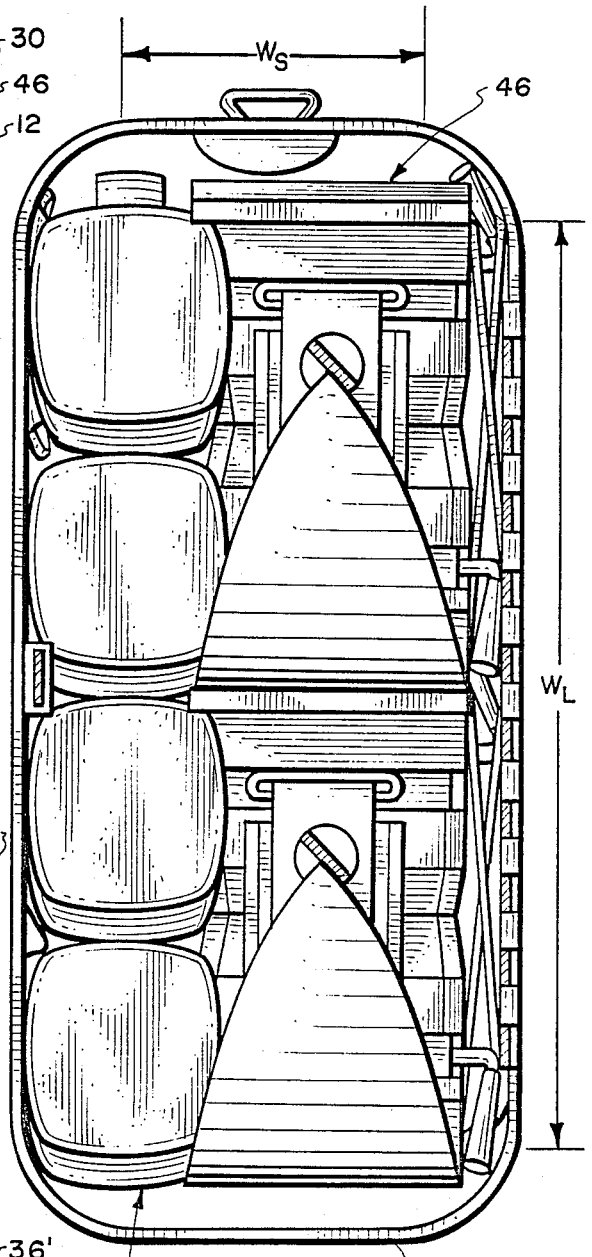
FIG. 6 is an end view of a ski container embodying the principals of the present invention which contains two pairs of skis and poles.

As illustrated in FIG. 6, an elongated tube 80 may be utilized which contains two or even more strapped units 46,46'. The generalized geometric relationship that defines the dimensions of the tube is expressed as $$\left(\frac{[1 + .712(n - 1)]2R}{[5(n - 1) + W_L] + 2R}\right) = K_1, \quad (1)$$

where n=the number of strapped pairs of skis to be inserted into the ski container, $$K_1 = 0.457, \text{ and } R = 1.6; \text{ and}$$

$$\left[\frac{2R}{W_S + 2R}\right] = K_2, \text{ where } K_2 = 0.610. \quad (2)$$

Obviously, many modifications and variations of the present invention are possible in light of the above teachings. It is therefore to be understood that, within the scope of the appended claims, the invention may be practiced otherwise than as specifically described.

For example, it is understood that the values for $K_1$, $K_2$ and R may differ from the above-described quantities by certain reasonable limits yet still embody the principals of the present invention. A reasonable range of values is listed below:

$0.411 < K_1 < 0.503$
$0.549 < K_2 < 0.671$
$1.28 < R < 1.92$

Furthermore, the thickness of the ski container may be increased near the open end to provide increased stiffness. Or, a doubler may be bonded to the inner surface of the tube along the perimeter of the cross-section to provide increased strength and stiffness.

What is claimed and desired to be secured by Letters Patent of the United States is:

1. A light weight apparatus for containing snow skis and ski poles, comprising:

(a) a rigid, unitary, elongated tube of sufficient length to contain skis, said tube formed by, a first flat surface having a length, L, and width, $W_L$, an opposing, parallel second flat surface having the same dimensions as said first flat surface, a third flat surface oriented perpendicular to said first and second flat surfaces having the same length as said first and second flat surfaces, but having a shorter width, $W_S$, than said first and second flat surfaces, a fourth flat surface having the same dimensions as said third flat surface which opposes said third flat surface, and four curved surfaces, each curved surface having a radius of curvature, R, for joining said flat surfaces, the elongated tube thereby having a substantially rectangular cross-section but having said curved surfaces at the corners of said cross-section, the geometrical dimensions of the cross-section of said elongated tube being defined by the relationships $$\left(\frac{[1 + .712(n - 1)]2R}{[5(n - 1) + W_L] + 2R}\right) = K_1, \quad (1)$$

where n=the number of strapped pairs of skis to be inserted into the ski container, $$\left[\frac{2R}{W_S + 2R}\right] = K_2, \text{ where } .549 < K_2 < .671, \quad (2)$$

said elongated tube having a closed first end for containing said skis and an open second end for allowing the introduction of said skis;

(b) an end cap hingedly attached to the opposite second end of said elongated tube;

(c) carrying means being attached to one of said flat surfaces for aiding in the carrying of said apparatus;

(d) locking means connected to said end cap and elongated tube for securing said end cap to a closed position relative to said elongated tube; and (e) means for strapping a pair of said skis and a pair of ski poles together as a single strapped unit for convenient insertion into and removal from said elongated tube, each ski having a flat portion and a tip formed on the forward portion of the ski and curved from the flat portion, said flat portion terminating in a tail end, each ski further having a toe binding and a heel binding each rigidly attached to said flat portion, the skis in each strapped unit being held closely adjacent to each other and oriented so that the bindings face each other and so that the tip of one ski is adjacent the tail of the other paired ski, each pair of ski poles being located adjacent each other on one side of the skis between the edges of the skis, each said strapped unit thereby being adapted to be insertable within said elongated tube with said ski poles adjacent the first flat surface of said tube and the flat surface of each ski being parallel to the third and fourth flat surfaces of said tube.

2. The apparatus of claim 1, wherein each heel binding includes a ski brake attached thereto, each ski brake normally extending at a significant angle from the plane of the flat portion of the ski, but each ski brake being depressable so as to change its angular orientation, said means for strapping said skis and poles together being adapted to depress said ski brake so as to have a portion thereof become substantially parallel to the plane of said flat portion of the ski.

3. The apparatus of claim 2 wherein said means for strapping said skis and poles together includes two straps formed with webbed cloth and mating halves of adhesive strips of synthetic material of the type that adheres when pressed together with a corresponding mating strip, each strap being located at each ski brake.

4. The apparatus of claim 2 wherein n=1.

5. The apparatus of claim 2 wherein n=2.

6. The apparatus of claim 1 wherein said elongated tube and end cap are each formed of blowmolded plastic.

7. The apparatus of claim 1 wherein said carrying means includes at least one strap.

8. A method for manufacturing an apparatus for containing snow skis and ski poles, comprising the steps of:

(a) blowmolding an elongated tube of sufficient length to contain skis, said tube defined by, a first flat surface having a length, L, and width, $W_L$, an opposing, parallel second flat surface having the same dimensions as said first flat surface, a third flat surface oriented perpendicular to said first and second flat surfaces having the same length as said first and second flat surfaces, but having a shorter width, $W_S$, than said first and second flat surfaces, a fourth flat surface having the same dimensions as said third flat surface which opposes said third flat surface, and four curved surfaces, each curved surface having a radius of curvature, R, for joining said flat surfaces, the elongated tube thereby having a substantially rectangular cross-section but having said curved surfaces at the corners of said cross-section, the geometrical dimensions of the cross-section of said elongated tube being defined by the relationships $$\left(\frac{[1 + .712(n - 1)]2R}{[5(n - 1) + W_L] + 2R}\right) = K_1, \quad (1)$$

where n = the number of strapped pairs of skis to be inserted into the ski container, $$\left[\frac{2R}{W_S + 2R}\right] = K_2, \text{ where } .549 < K_2 < .671, \quad (2)$$

said elongated tube having a closed first end and a closed second end;

(b) detaching one of said end portions after the blowmolding process is completed;

(c) hinging said detached end portion to the elongated tube;

(d) attaching carrying means to one of said flat surfaces for aiding in the carrying of said apparatus;

(e) connecting locking means to said elongated tube for securing said end cap to a closed position relative to said elongated tube; and (f) providing means for strapping a pair of said skis and a pair of ski poles together as a single strapped unit for convenient insertion into and removal from said elongated tube each ski having a flat portion and a tip formed on the forward portion of the ski and curved from the flat portion, said flat portion terminating in a tail end, each ski further having a toe binding and a heel binding each rigidly attached to 40 said flat portion, the skis in each strapped unit being held closely adjacent to each other and oriented so that the bindings face each other and so that the tip of one ski is adjacent the tail of the other paired ski, each pair of ski poles being located adjacent each other on one side of the skis between the edges of the skis, each said strapped unit thereby being adapted to be insertable within said elongated tube with said ski poles adjacent the first flat surface of said tube and the flat surface of each ski being parallel to the third and fourth flat surfaces of said tube.

* * * * *

UNITED STATES PATENT AND TRADEMARK OFFICE

CERTIFICATE OF CORRECTION

PATENT NO. : 4,860,935

DATED : 08/29/89

INVENTOR(S) : Pavlinsky

It is certified that error appears in the above-identified patent and that said Letters Patent is hereby corrected as shown below:

On the title page

[76] Inventor: delete "Joseph F. Paylinsky" insert --Joseph F. Pavlinsky-- col. 01, line 41 insert between "deep" & "means" --skirts for adjustably fitting upon opposing ends of the tube for providing--

Signed and Sealed this

Ninth Day of October, 1990

*Attest:*

HARRY F. MANBECK, JR.

*Attesting Officer*

*Commissioner of Patents and Trademarks*